US005344605A

United States Patent [19]

Kaji et al.

[11] Patent Number: 5,344,605

[45] Date of Patent: Sep. 6, 1994

[54] METHOD OF DEGASSING AND SOLIDIFYING AN ALUMINUM ALLOY POWDER

[75] Inventors: Toshihiko Kaji; Yoshinobu Takeda; Yuusuke Odani; Kiyoaki Akechi; Takao Tanji, all of Itami, Japan

[73] Assignee: Sumitomo Electric Industries, Ltd., Osaka, Japan

[21] Appl. No.: 94,062

[22] PCT Filed: Nov. 20, 1992

[86] PCT No.: PCT/JP92/01527

§ 371 Date: Sep. 21, 1993

§ 102(e) Date: Sep. 21, 1993

[87] PCT Pub. No.: WO93/09899

PCT Pub. Date: May 27, 1993

[30] Foreign Application Priority Data

Nov. 22, 1991 [JP] Japan ..... 3-307873
Feb. 4, 1992 [JP] Japan ..... 4-047695
Nov. 20, 1992 [JP] Japan ..... 4-333901

[51] Int. Cl.[5] ..... B22F 1/00; B22F 3/16

[52] U.S. Cl. ..... 419/31; 419/38; 419/44; 419/54; 148/513; 148/514

[58] Field of Search ..... 419/31, 38, 44, 54; 148/513, 514

[56] References Cited

U.S. PATENT DOCUMENTS

| | | | |
|---|---|---|---|
| 3,544,392 | 12/1970 | Lyle, Jr. et al. | 148/11.5 |
| 3,619,894 | 11/1971 | Gualandi et al. | 29/420.5 |
| 3,871,877 | 3/1975 | Storchheim | 75/214 |
| 4,101,348 | 7/1978 | Berchtold | 148/105 |
| 4,177,069 | 12/1979 | Kobayashi et al. | 75/213 |
| 4,313,759 | 2/1982 | Raybould | 75/249 |
| 4,331,477 | 5/1982 | Kubo et al. | 75/228 |
| 4,333,775 | 6/1982 | Mahrus | 148/11.5 Q |
| 4,365,996 | 12/1982 | Melton et al. | 419/28 |
| 4,435,213 | 3/1984 | Hildeman et al. | 75/249 |
| 4,609,526 | 9/1986 | Haswell et al. | 419/23 |
| 4,661,172 | 4/1987 | Skinner et al. | 148/12.7 A |
| 4,702,885 | 10/1987 | Odani et al. | 419/23 |
| 4,722,751 | 2/1988 | Akechi et al. | 75/232 |
| 4,722,754 | 2/1988 | Ghosh et al. | 148/11.5 A |
| 4,729,790 | 3/1988 | Skinner et al. | 75/249 |
| 4,732,610 | 3/1988 | Hildeman et al. | 75/249 |
| 4,762,679 | 8/1988 | Gegel et al. | 419/28 |
| 4,808,225 | 2/1989 | Donachie et al. | 75/246 |
| 4,857,267 | 8/1989 | Maki et al. | 419/31 |
| 4,937,042 | 6/1990 | Parkins et al. | 419/8 |
| 5,134,260 | 7/1992 | Piehler et al. | 219/10.41 |

*Primary Examiner*—Donald P. Walsh
*Assistant Examiner*—Daniel J. Jenkins
*Attorney, Agent, or Firm*—Wenderoth, Lind & Ponack

[57] ABSTRACT

The object is to provide a method of degassing or solidifying an aluminum alloy powder by utilizing an induction heating as a degassing means in a step of forming and solidifying an aluminum powder or aluminum alloy powder, whereby the disadvantages of the prior art can be overcome. The feature of the present invention consists in preforming an aluminum powder, aluminum alloy powder or aluminum composite alloy powder or mixed powders thereof with non-metallic grains to give a specific electric resistance of at most 0.2Ωcm, subjecting the preform directly to induction heating in an atmosphere at normal pressure, temperature-raising to 400° to 600° C. at a temperature gradient of at least 0.4° C./sec in a temperature range of at least 300° C. and removing heat-decomposable volatile components to obtain a hydrogen content of at most 10 ppm.

10 Claims, 1 Drawing Sheet

METHOD OF DEGASSING AND SOLIDIFYING AN ALUMINUM ALLOY POWDER

TECHNICAL FIELD

This invention relates to a method of degassing and solidifying a rapidly solidified aluminum alloy powder.

BACKGROUND TECHNIQUE

As a method of forming and solidifying a rapidly solidified aluminum alloy powder, there are various methods, for example, extrusion method, HIP method, powder forging method, etc. For solidifying a powder, it is necessary to heat the powder by all means, during which the quenching effect of the powder is lost to deteriorate the properties. Prevention of this deterioration is carried out by rapidly heating in a short time. A patented invention relating to carrying out rapidly heating for the purpose of solidifying a rapidly solidified aluminum alloy powder is 1. U.S. Pat. No. 4,435,213: "Method for Producing Aluminum Powder Alloy Products Having Improved Strength Properties; Alcore", a patented invention relating to induction heating of general powders, not limited to aluminum, is 2. U.S. Pat. No. 5,134,260: "Method and Apparatus for Inductively Heating Powders or Powder Compacts for Consolidation; Carnegie Melon University" and a patented invention relating to rapidly heating by hot air is 3. Japanese Patent Laid-Open Publication No. 158401/1991: "Method of Heating Rapidly Solidified Powders; Kubota".

To any one of the above described powder forging method, extrusion method and HIP method, well known in the art, is indispensable the heating before solidification because of 1. decreasing a deformation resistance of a powder and shaping the powder with a low stress and 2. degassing.

In particular, the degassing is an indispensable means for preventing a solidified article from forming of bubbles called blistering and in the case of the powder forging, strongly bonding grains with each other, for example, like known methods described in Japanese Patent Laid-Open Publication No. 224602/1987 and "Kei-Kinzoku (Light Metals)" 37 (10) 1987, page 656–664.

In the prior art techniques, degassing has generally been carried out by can-sealing a CIP (cold isotactic pressing) body and heating in vacuum or in an inert gas atmosphere at a temperature of 400° to 600 ° C. Any prior art method has aimed at completing sufficiently degassing by raising the temperature for 0.5 to 2 hours and maintianing a predetermined temperature for 0.5 to 2 hours, amounting to 1 to 4 hours, using an ordinary resistance heating furnace.

However, it has hitherto been pointed out that the above described degassing method has the disadvantages that the quenching effect of a powder, i.e. the effect of precipitating finely and unifromly an element or phase which tends to be coarsely precipitated at an ordinary cooling rate or the effect of rendering crystal grains fine is lost by heating for a long time to deteriorate the properties of a shaped and solidified body, and moreover, prevention of oxidation during then needs controlling of the atmosphere, resulting in rising of the production cost.

Heating rapidly and uniformly a material having a low heat conductivity such as green compacts has generally been considered difficult. Ordinarily, the most suitable method for rapid heating on a commercial scale is an inductive heating. For example, it has been reported in Japanese Laid-Open Publication No. 134503/1974 that for powder metallurgy of a ferruginous metal, a high frequency induction heating is utilized for heating and sintering a green compact. Up to the present time, such a high frequency inductive heating has been utilized for previous heating in sintering in a shorttime or sintering forging (forging for increasing the density of a preform which is being sintered).

However, the inductive heating has not been used for degassing of a green compact of aluminum powder or aluminum alloy powder. The reasons therefor are as follows:

It has been considered that the presence of a stable alumina film ($Al_2O_3$) with a low electric conductivity on surfaces of aluminum powder or aluminum alloy powder results in increase of the resistance of the powder and decrease of the electric conductivity of a green compact and an effective heating is impossible by induction heating since Joule's heat is hard to be generated in a material with a low electric conductivity, such as aluminum, eddy current is hard to be generated in the green compact and aluminum itself has a smaller magnetic permeability different from ferruginous materials.

Furthermore, it has been considered that even if the induction heating of the powder pressed compact can be carried out, a temperature difference between the surface and central part thereof is so large due to the low heat conductivity thereof that it is impossible to heat at a uniform temperature.

Under the situation, the present invention provides a method of degassing aluminum powder or an aluminum alloy powder comprising utilizing induction heating for a degassing means in a step of forming and solidifying the aluminum powder or aluminum alloy powder, whereby the above described disadvantages of the prior art can be overocme.

When solidifying a rapidly solidified aluminum alloy powder, the following subjects should be taken into consideration:

(A) A thermal history added to a powder is minimized so as to minimize deterioration of the texture of the powder by heating for solidification.

(B) Bonding of aluminum powder with each other is rendered as strong as possible.

(C) The solidification is carried out with a low cost.

Above all, for accomplishing the subject (A), the rapid heating method by the induction heating or hot air heating method as disclosed in the foregoing three patents is favourable. In the rapid heating method, however, there arises a problem that the bonding of aluminum powder with each other [subject (B)] is hard to take place. Therefore, the heating in the air, as described in Example of the patent 1, results in lowering of the fracture elongation even if the extrusion is carried out. For the purpose of compensating this subject, it is required to carry out the rapid heating in an inert gas, to carry out vacuum degassing before the solidification and to increase the elongation or fracture toughness value of the solidified material by extrusion or swageing working to cause a large plastic deformation after the solidification. In the patent 3, an apparatus for rapid heating in vacuum is provided. However, the subject (C), i.e. solidification with a low cost cannot be accomplished by addition of these steps.

The present invention provides means for solving the above described subjects (A), (B) and (C) and provides a solidified body having a higher strength and toughness without lowering mechanical properties as compared with any of solidifying methods of the prior art and a solidifying method for obtaining the same in economical manner.

DISCLOSURE OF THE INVENTION

The inventors have made various studies to solve the above described problems and consequently, have found a method whereby degassing of aluminum or aluminum alloy powder can be carried out with suppressing deterioration thereof by the use of induction heating and the heating time can be decreased to about 1/10 of the prior art. The present invention is based on this finding.

Accordingly, the present invention provides a method of degassing aluminum powder, aluminum alloy powder or aluminum composite alloy powder or mixed powders thereof with non-metallic grains, before solidification thereof, characterized by preforming the powder body to give a specific electric resistance of at most 0.2Ωcm, subjecting the preform directly to induction heating in an atmosphere at normal pressure, temperature-raising to 400° to 600° C. at a temperature gradient of at least 0.4° C./sec in a temperature range of at least 300° C., and removing heat-decomposable volatile components to obtain a hydrogen content of at most 10 ppm.

In the present invention, the above described induction heating can be carried out in the atmosphere.

In the present invention, moreover, readsorption of moisture can be prevented by, after degassing by the above described induction heating, cooling the preform in an inert gas atmosphere.

In addition, the inventors have made various studies to solve the above dsecribed problems and consequently, have found that the following procedures, differing from the prior art, are the most suitable for achieving the above described subjects (A), (B) and (C), leading to the present invention.

(i) As to heating of the powder, rapid heating is employed as usual, but the heating temperature is maintained at at least 30° C. higher than in the prior art.

(ii) As to solidifying of the powder, it is preferable to use a powder forging method, not a HIP method nor extrusion method.

(iii) The atmosphere for rapid heating should be not vacuum nor inert gas atmospheres, but inexpensive stagnant atmospheres at normal pressure (the stagnant atmosphere).

(iv) Rapid cooling is carried out after powder forging.

That is, the feature of the present invention consists in preforming aluminum powder, aluminum alloy powder or aluminum composite alloy powder or mixed powders thereof with non-metallic grains to give a specific electric resistance of at most 0.2 Ωcm, subjecting the preform directly to induction heating in a stagnant atmosphere at normal pressure, maintaining a temperature-raising gradient of at least 0.4° C./sec at a temperature range of at least 300° C., temperature-raising to 400° to 600° C. corresponding to a temperature of at least 30° C. higher than the vacuum degassing temperature applied to a case of extruding the above described powder, removing heat-decomposable volatile components to obtain a hydrogen content of at most 10 ppm, then directly subjecting a product to hot working and thus solidifying the product.

As to the heating temperature, a higher temperature, i.e. 400° C. to the melting point can be chosen in the case of an alloy containing only an alloying element (Fe, Ni, etc.) which does not lower the melting point of Al (MP 660° C.). As a preferred embodiment of the present invention, a powder forging method can be used as the above described hot working.

In the present invention, the above described induction heating can be carried out in the inexpensive stagnant atmosphere and moreover, both the strength and toughness can more be improved than in the prior art without degassing in vacuum before solidifying, without subjecting to plastic working such as extrusion after solidifying and without lowering the elongation and fracture toughness.

Furthermore, the feature of the present invention consists in quenching at a rate of at least 10° C. immediately after forging, or reheating at a temperature of at most the forging temperature and at least (the forging temperature −50° C.) without cooling to room temperature and subjecting to a quenching and solution treatment.

In addition, a particularly preferable embodiment of the present invention comprises carrying out the preforming of the above described powder after coating the inner wall of a metallic mold with a wetting agent without adding an organic wetting agent to the powder.

Infrared radiation heating or direct electric heating can also be used instead of the above described induction heating.

BEST EMBODIMENT FOR CARRYING OUT THE INVENTION

Figure 1:
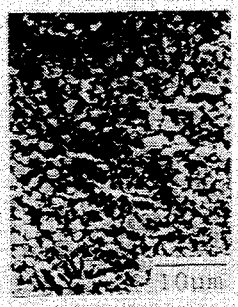
FIG. 1 is an SEM photograph instead of a drawing of a texture of a forged body obtained in Example 2-1) of the present invention.

Considering that it is difficult to heat the whole body of a green compact at a uniform temperature in a short time, heating for a long time, e.g. at least 1 hour has ordinarily been carried out using a resistance heating furnace up to the present time, but the quenching effect of a powder is lost because of being exposed to the high temperature for a long time, as described above. Since $H_2O$ component in the air hinders the above dscribed $H_2O$ release reaction and $O_2$ component in the air oxidizes the powder, moreover, the heating has generally been carried out in vacuum, in a low dew point and low $O_2$ concentration atmosphere or in an inert gas atmosphere so as to prevent this phenomenon.

On other hand, according to conditions found as a result of the inventor's studies, it is rendered possible to rapidly heat a formed body of aluminum powder or aluminum alloy powder by induction heating which has hitherto been considered unsuitable and to effect sufficient degassing even by induction heating in the air, since removal of adsorbed water or crystallization water can sufficiently be effected by heating in a short time and because of shortening of the heating time, the contact time with the atmosphere at a high temperature is short.

That is, the above described conditions are that the compacting pressure of a pressing mold is increased by about 20 % as large as the prior art so as to increase electric contact of a powder with each other, and an incident direction of magnetic induction flux of a high frequency and the frequency of the high frequency are selected to be optimum.

Examples of the aluminum alloy powder used in the present invention include not only the rapidly solidified alloy powders but also those prepared by any other methods. The composition thereof is not limited, but can be an aluminum composite alloy powder (aluminum or aluminum alloy powder in which a nonmetallic or intermetallic compound is dispersed). Aluminum powder can also be used. In addition, non-metallic grains such as SiC or $Al_2O_3$ grains can be mixed with these powders.

Firstly, aluminum powder, aluminum alloy powders, aluminum composite alloy powders or mixed powders thereof with non-metallic grains are respectively formed into a preform with an increased density to give a specific electric resistance of at most 0.2Ωcm. The forming in this case can be carried out by a mold pressing method such as uniaxial compression method, a CIP method or other methods, without using heat-decomposable organic lubricants. The powder grains are thus subject to micro-shearing forces with each other so that they have metallic contact areas with each other.

When the specific electric resistance exceeds 0.2 Ωcm, eddy current is hard to flow and the temperature of the preform is not readily raised even by induction heating. If an output of an electric source is increased to fast raise the temperature, the temperature gradient between the surface of the preform and interior part thereof is increased due to low heat conductivity of the preform with the large electric resistance value and cracks tend to occur due to thermal strain. The specific electric resistance of at most 0.2 Ωcm can generally be accomplished by a compacting pressure of 4 to 6 tons/cm$^2$. When this is not accomplished within this range, the mold pressing is carried out at a high pressure or after the temperature of the powder is raised to decrease a deformation resistance thereof.

The preform is then subjected directly to induction heating using an electric source and rapidly heated at 400° to 600° C. while maintaining a temperature-raising rate of 0.4° C./sec at a temperature of at least 300° C., during which the frequency is preferably adjusted to 3 kHz according to the inventor's experiment, although an optimum frequency can suitably be chosen depending on a subject to be heated.

During solidifying a rapidly solidified powder, its behaviours of the interior part and surface part are different. That is, the interior state mainly governs a tensile strength and hardness, so if the thermal history for solidification is reduced, the tensile strength and hardness of the powder itself are naturally increased. On the other hand, properties such as fracture elongation and fracture toughness are mainly governed by the surface state of the rapidly solidified powder.

An oxide film, i.e. alumina ($Al_2O_3$) on the surface of the aluminum powder is such a stable compound that is hardly removed by reduction. This oxide film hinders strong bonding of the aluminum alloy powder grains with each other. Accordingly, there has been proposed a method comprising subjecting the powder to a plastic flow working, e.g. extrusion or upset working, thus meachanically breaking the oxide film, exposing and bonding fresh surfaces of aluminum. It has been known up to-the present time, however, that even when using the extrusion method, there is obtained only a product with a low elongation and low fracture toughnes value if degassing before the solidification is insufficient. Now, the degassing method will be illustarted:

A gas-atomized and rapidly solified aluminum alloy powder has an oxide film with a thickness of 50 to 100Å covered on the surface thereof, the surface oxide film further containing adsorbed water or crystallization water, which causes lowering of the elongation or fracture toughness value of the solidified material.

These water componets can be removed by the following reactions:

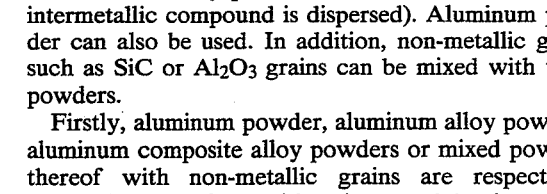

$$H_2O\ (liq) \rightarrow H_2O\ (gas)$$

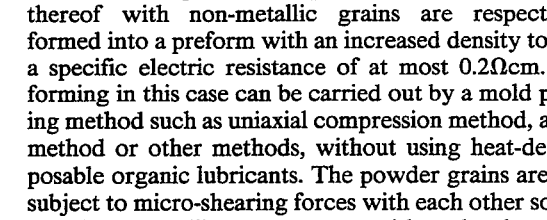

$$Al_2O_3.3H_2O \rightarrow Al_2O_3.H_2O + 2H_2O\ (gas)$$

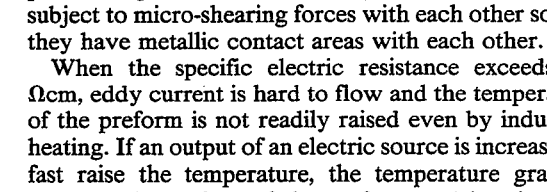

$$Al_2O_3.H_2O \rightarrow Al_2O_3 + H_2O\ (gas)$$

This removal reaction takes place at 100° to 400° C. and at a temperature of 300° C. or higher, water vapor generated by the above described reaction directly reacts with aluminum to evolve hydrogen. That is, thew following reaction takes place,

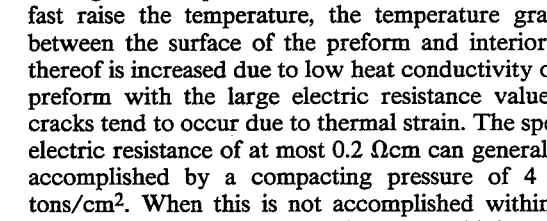

$$2Al + 3H_2O \rightarrow Al_2O_3 + 3H_2\ (gas)$$

A method having been employed to accelerate these reactions comprises heating for a long time (longer time allows to proceed more reactions), heating in vacuum (lower atmospheric pressure results in tendency of proceeding of these reactions to right) or heating in an inert gas with a low dew point (these reactions tend to proceed to right because of less $H_2O$ (gas) at a low dew point). The object of using the inert gas atmosphere is to prevent the powder from oxidation.

From this point of view, it can be understood that rapid heating is effective for breaking the structure of the interior part of the powder but is disadvantageous from such a point of view that release of the water adsorbed on the surface oxide film of the powder and the crystallization water is accelerated. It is probably due to this reason that in Examples 1 and 2 of the foregoing Patent 3, the tensile strength is improved but the elongation and fracture toughness value are lowered. In Example 3, both the tensile strength and elongation are improved, which is probably due to that the heating in an inert gas and the subsequent degassing in vacuum are carried out in this Example. However, it is assumed that an ordinary heat treatment (T7) is finally carried out in this Example and the effect of the rapid heating is decreased to half.

The inventors have made various examinations as to methods whereby a sufficient degassing can be carried out in economical manner even when using a rapid heating and consequently, have found that this problem can be solved by utilizing the hydrogen gas evolved by the above described release reaction. The above described generation of hydrogen gas takes place, in particular, at a high temperature. The amount of the thus generated hydrogen gas, depending on the heating temperature, is generally about 30 ppm. There are pores of about 25% in a green compact of the powder and the volume of the hydrogen generated amounts to about 10 times as much as that of the pores. In this case, it is required to hold the generated hydrogen in the pores of the green compact and to introduce an inert gas into around the green compact without stirring the atmosphere, in particular, to maintain a stagnant atmosphere, so as to impart to the hydrogen a function of turning out harmful steam or oxygen present in the pores of the green compact and allowing the foregoing reactions to proceed. Furthermore, in order to generate the hydrogen in a large amount at once, the heating at a temperature of at least 300° C. for generating hydrogen should be carried out at a rate of at least 0.4° C./sec, and in order to generate hydrogen in a large amount in a series of the degassing reactions, it is required to heat up to a temperature of as higher as possible. Therefore, the heating temperature should be a temperature of at least 30° C., preferably at least 50° C. higher than that of the vacuum degassing carried out before extrusion in the prior art (generally heated at about 450° C.). In this way, the structure of the powder surface tends to be fixedly bonded. As a measure of the tendency of bonding of the powder, it is required that that the amount of the residual hydrogen is at most 10 ppm.

When the heating temperature is higher, the structure of the interior part of the powder tends to be coarse even if rapid heating is effected and it is required to carry out (i) heating in a short time, (ii) solidifying in a short time and (iii) quenching after solidifying.

(i) For the purpose of rendering most advantageous "heating in a short time", it is necessary to make an object to be heated as smaller as possible. In this respect, in the extrusion method, the end part and residual part are discarded and a large green compact is used to obtain a plurality of products in one extrusion and to increase the yield, so that the rapid heating is naturally limited. On the other hand, in the present invention, one green compact is small and the rapid heating is possible. A green compact is generally subjected to CIP (cold isotactic pressing), but in the powder forging, a uniaxial compression method by a metallic mold is applied. In this case, shearing of the powder acts each other more effectively when compressed uniaxially than when compressed isotropically and contact of the powder grains is increased by the newly exposed surfaces. Thus, inductive eddy current is increased and heat generated in the vicinity of the compact surface is more rapidly propagated to the interior part. Therefore, the forging method is more advantageous in this respect.

(ii) The most effective solidifying method for solidifying in a short time is also the powder forging method. The time required for powder forging is about 0.7 second as compared with about 5 minutes required for extrusion and about 20 minutes required for HIP (hot isotactic pressing).

(iii) For quenching after solidifying, it is required to separate a product from a tool used for working after hot working and powder forging is advantageous for this purpose. As to the cooling rate, about 100° C./sec can be accomplished by water cooling, but in this case, there is a fear of cracking, in particular, when using a brittle material. In such a case, blowing-against of cooling air (cooling rate of about 10° to 20° C./sec) should be carried out and the cooling rate is thus adjusted to at least 10 ° C./sec. Since it is thought that a sufficient solution treatment cannot be effected sometimes by only direct cooling after forging in the case of alloys of heat treatment type, it is preferable to reheat just after forging, rather than reheating after cooling to room temperature, so as to reduce the thermal history to as small as possible during the same time. The reheating temperature during the same time is specified to at most the forging temperature to (the forging temperature −50° C.) for the purpose of preventing generation of blisters and obtaining a sufficient annealing.

When plastic working is carried out after solidifying in order to reduce the thermal history, moreover, heating is necessary for the plastic working. Accordingly, this is not preferable. An organic lubricant is not added because of lowering the heat conductivity during heating the green compact and hindering rapid rising of the temperature by the evaporation heat thereof. The rapid heating is most preferably carried out by induction heating, but can also be carried out by irradiation heating or direct electric heating.

A solidified body according to the present invention has a feature such as to be more changeable (concerning the structure distribution of a precipitate, obtained by X-ray diffraction, shape of a precipitate, size of a precipitate -tendency of coarsening-) for a same composition at a high temperature (substantially same as the powder forging temperature) because of containing more non-equilibrium phases, than those prepared by other methods. When a powder is heated for a long time in an inert gas and then subjected to extrusion or powder forging so as to turn out the air (predominantly consisting of nitrogen) contained in pores or gaps by hydrogen released from the powder surface, $N_2$ or Ar element can be detected, while in the solidified body of the present invention, such elements are contained only in an amount of at most the detectable limit.

The degassed powder obtained according to the present invention, having such a clean surface as having little adsorbed water or crystalline water, can be subjected to powder forging as heated. Accordingly, this is forged by a known forging method just after degassing. However, an induction heating has the disadvantage that the temperature of a body to be heated is more nonuniform as compared with an ordinary atmospheric heating furnace and accordingly, when the temperature gradient is large, the temperature thereof can be rendered uniform by holding at a predetermined temperature in an atmospheric heating furnace after temperature raising, during which the atmosphere should be of an inert gas.

The preform rapidly heated and degassed in this way is immediately charged in a metallic mold at about 200° C. and subjected to forging at a compacting pressure of 2 to 12 tons/cm$^2$.

EXAMPLES

The present invention will now be ilustrated in detail by the following examples without limiting the same. In the following Experimental Examples and Examples, an induction heating is carried out by about 3 kHz.

Experimental Example A

About 250 g of an air-atomized powder (mean grain diameter: about 50 μm) with a composition of Al-25Si-2.5Cu-1Mg (by weight) was compacted at a compacting pressure of 4 tons/cm$^2$ in a diameter 100 mm × height 20 mm to give a specific electric resistance of 0.02 Ωcm, heated to 500° C. under the following conditions A-1) to A-5), removed into a can having an Ar atmosphere when the heating was finished, cooled to 50° C. within 1 minute in an Ar stream, and then subjected to measurement of the quantity of oxygen and the quantity of hydrogen in the powder, the hardness (mHv) and the grain diameter of primary crystal Si. The results are shown in Table 1.

| | | |
|---|---|---|
| A-1) | Induction heating in the air (32° C./sec) | Present Invention |
| A-2) | Induction heating in the air (8.0° C./sec) | Present Invention |
| A-3) | Induction heating in the air (4.0° C./sec) | Present Invention |
| A-4) | Induction heating in the air (0.8° C./sec) | Present Invention |
| A-5) | Induction heating in the air (0.2° C./sec) | Outside Present Invention |
| For comparison, the same compacted body was heated to 500° C. under the following conditions A-6) to A-8) using a resistance heating furnace. | | |
| A-6) | Resistance furnace heating in vacuum (maintained for 1 hour) | Outside Present Invention |
| A-7) | Resistance furnace heating in $N_2$ atmosphere (maintained for 1 hour) | Outside Present Invention |
| A-8) | Resistance furnace heating in the air (maintained for 1 hour) | Outside Present Invention |

The properties of the alloy powders thus obtained are shown in Table 1.

TABLE 1

| Heating Conditions | Oxygen Quantity (wt %) | Hydrogen Quantity (ppm) | Powder Hardness (mHv) | Primary Crystal Si Grain Diameter (μm) |
|---|---|---|---|---|
| Within Present Invention | | | | |
| A-1 | 0.27 | 3 | 172 | 3.2 |
| A-2 | 0.28 | 4 | 153 | 3.1 |
| A-3 | 0.30 | 3 | 130 | 4.0 |
| A-4 | 0.28 | 5 | 115 | 7.8 |
| Outside Present Invention | | | | |
| A-5 | 0.33 | 6 | 100 | 10.2 |
| A-6 | 0.28 | 3 | 92 | 11.2 |
| A-7 | 0.28 | 9 | 95 | 10.7 |
| A-8 | 0.38 | 17 | 102 | 10.0 |

Note 1: Powder Hardnes (mHv): mean value of five points
Note 2: Primary Crystal Si Grain Diameter: mean value of thirty samples From the results of Table 1, it is apparent that 1) the degree of degassing can substantially be obtained as in degassing in vacuum and 2) the structure is not coarsened and the hardness is high because of little thermal history.

Experimental Example B

The procedures under the conditions of Experimental Examples A-1), A-4), A-5), A-7) and A-8) were repeated except using a mixed powder of air-atomized, industrial grade pure aluminum powder (mean grain diameter: 50 μm) and 30 volume % of SiC grains with a mean grain diameter of 1.5 μm, as a raw material powder. The properties of the resulting powders are shown in Table 2, in which the powder hardness is masured as to the aluminum powder.

TABLE 2

| Experimental Example | Heating Conditions | Oxygen Quantity (wt %) | Hydrogen Quantity (ppm) | Powder Hardness (mHv) | Primary Crystal Si Grain Diameter (μm) |
|---|---|---|---|---|---|
| Within Present Invention | | | | | |
| B-1 | A-1 | 0.20 | 4 | 95 | — |

TABLE 2-continued

| Experimental Example | Heating Conditions | Oxygen Quantity (wt %) | Hydrogen Quantity (ppm) | Powder Hardness (mHv) | Primary Crystal Si Grain Diameter (μm) |
|---|---|---|---|---|---|
| B-2 | A-4 | 0.19 | 5 | 93 | — |
| Outside Present Invention | | | | | |
| B-3 | A-5 | 0.26 | 7 | 85 | — |
| B-4 | A-7 | 0.21 | 8 | 63 | — |
| B-5 | A-8 | 0.32 | 15 | 62 | — |

Note 1: Powder Hardness (mHv): mean value of five points

Experimental Example C

The procedures under the conditions of Experimental Examples A-1), A-4), A-5), A-7) and A-8) were repeated except using a mixed powder of air-atomized, Al-20Si-5Fe-2Ni alloy powder (mean grain diameter: 50 μm) and alumina powder with a mean grain diameter of 0.5 μm, as a raw material powder. The properties of the resulting powders are shown in Table 3. The quantity of oxygen is a quantity from which the quantity of oxygen contained in the alumina grains has been removed by calculation. The powder hardness is masured as to the aluminum alloy powder.

TABLE 3

| Experimental Example | Heating Conditions | Oxygen Quantity (wt %) | Hydrogen Quantity (ppm) | Powder Hardness (mHv) | Primary Crystal Si Grain Diameter (μm) |
|---|---|---|---|---|---|
| Within Present Invention | | | | | |
| C-1 | A-1 | 0.26 | 4 | 186 | 2.6 |
| C-2 | A-4 | 0.29 | 3 | 179 | 2.4 |
| Outside Present Invention | | | | | |
| C-3 | A-5 | 0.32 | 5 | 145 | 5.6 |
| C-4 | A-7 | 0.28 | 10 | 108 | 6.8 |
| C-5 | A-8 | 0.40 | 19 | 113 | 6.5 |

Note 1: Powder Hardness (mHv): mean value of five points
Note 2: Primary Crystal Si Grain Diameter: mean value of thirty samples

Experimental Example D

About 500 g of an air-atomized powder with a composition of Al-20Si-5Fe-1Ni (mean grain diameter: 50 μm) was compacted in a diameter of 100 mm and height of 40 mm while varying the compacting density as shown in Table 4, and then subjected to measurement of the specific electric resistance. In the central part and outer circumferential part of the green compact were respectively made two holes each having a diameter of 1.0 mm in which a thermocouple is to be inserted and the temperature raising gradient was sought in which the temperature gradient between both the sites was not 70° C. or higher and the fastest temperature raising could be obtained.

TABLE 4

| Green Compact No. | Specific Electric Resistance of Green Compact (Ω cm) | Maximum Temperature-Raising Gradient in Which Temperature Gradient between Central Part and Peripheral Part of Green Compact is not 70° C. or Higher (°C./sec) |
|---|---|---|
| D-1 | 0.001 | 25 |

TABLE 4-continued

| Green Compact No. | Specific Electric Resistance of Green Compact (Ω cm) | Maximum Temperature-Raising Gradient in Which Temperature Gradient between Central Part and Peripheral Part of Green Compact is not 70° C. or Higher (°C./sec) |
|---|---|---|
| D-2 | 0.005 | 16 |
| D-3 | 0.01 | 8 |
| D-4 | 0.02 | 3.2 |
| D-5 | 0.05 | 2 |
| D-6 | 0.1 | 0.9 |
| D-7 | 0.2 | 0.4 |
| D-8 | 0.5 | 0.2 |
| D-9 | 1.0 | 0.09 |
| D-10 | 2.0 | not reached 500° C. |

As shown in Table 4, the temperature-raising efficiency is not good at a specific electric resistance of about 0.2Ω cm or more.

EXAMPLE 1

An air-atomized powder (mean grain diameter: about 50 μm) with a composition of Al-25Si-2.5Cu-1Mg (by weight, same hereinafter) was compacted in a diameter 100 mm×height 20 mm to give a specific electric resistance of 0.02 Ωcm and heated in the air to 500° C. from room temperature for 4 minutes by induction heating. The product was immediately charged in a metallic mold (200° C.) lined with graphite lubricant, powder-forged at a compacting pressure of 8 tons/cm$^2$ and just after the forging, cooled by immersing in water at room temperature. The foreged body was subjected to natural ageing for 4 days, after which Rockwell hardness B scale ($H_RB$) was measured to obtain an $H_RB$ of 86.

For comparison, the green compact prepared in the similar manner to Example 1 was heated for 1 hour in a nitrogen atmosphere at 500° C. in a resistance furnace and after heating, forged, cooled and then subjected to natural ageing and measurement of the hardness to obtain an $H_RB$ of 79 (Comparative Example 1).

EXAMPLE 2

250 g of an air-atomized powder (mean grain diameter: about 50 μm) with a composition of Al-25Si-2.5Cu-1Mg was compacted at a compacting pressure of 4 tons/cm$^2$ in a diameter 100 mm×height 20 mm to give a specific electric resistance of 0.02 Ωcm, heated to 500° C. under the following conditions 2-1) to 2-5), charged into a mold heated at 200° C. when the heating was finished, subjected to powder forging at a compacting pressure of 8 tons/cm$^2$, immediately cooled by immersing in water. Therefore, the product was subjected to natural ageing for 4 days.

In the case of 2–3'), "moistened", the green compact was exposed to an atmosphere at a temperature of 40° C. and a humidity of 90% for 24 hours, before heating and degassing, thus adsorbing a large amount of water on the surface of the powder, and then subjected to the steps after the heating and degassing in the similar manner.

| | | |
|---|---|---|
| 2-1) | Induction heating in air (32° C./sec) | Present Invention |
| 2-2) | Induction heating in the air (8.0° C./sec) | Present Invention |
| 2-3) | Induction heating in the air (4.0° C./sec) | Present Invention |
| 2-3') | Induction heating in the air moistened (4.0° C./sec) | Present Invention |
| 2-4) | Induction heating in the air (0.8° C./sec) | Present Invention |
| 2-5) | Induction heating in the air (0.2° C./sec) | Outside Present Invention |

For comparison, the same compact was heated to 500° C. under the following conditions 2–6) to 2–7) using a resistance heating furnace, forged, then heated at 485° C. for 2 hours and immersed in water to effect a solution treatment and thereafter, subjected to natural ageing for 4 days.

| | | |
|---|---|---|
| 2-6) | Resistance furnace heating in $N_2$ atmosphere (maintained for 1 hour) | Outside Present Invention |
| 2-6') | Resistance furnace heating in $N_2$ atmosphere (maintained for 1 hour) moistened | Outside Present Invention |
| 2-7) | Resistance furnace heating in the air (maintained for 1 hour) | Outside Present Invention |
| 2-7') | Resistance furnace heating in the air (maintained for 1 hour) moistened | Outside Present Invention |

The properties of the alloy powders thus obtained are shown in Table 5.

TABLE 5

| Sample No. | Degassing Conditions: Heating Means | Atmosphere | Temperature Conditions | Moistened |
|---|---|---|---|---|
| Example | | | | |
| 2-1 | Induction Heating | In The Air | Temp. Raising at 32° C./sec | No |
| 2-2 | Induction Heating | In The Air | Temp. Raising at 8.0° C./sec | No |
| 2-3 | Induction Heating | In The Air | Temp. Raising at 4.0° C./sec | No |
| 2-3' | Induction Heating | In The Air | Temp. Raising at 4.0° C./sec | Yes |
| 2-4 | Induction Heating | In The Air | Temp. Raising at 8.0° C./sec | No |
| Comparative Example | | | | |
| 2-5 | Induction Heating | In The Air | Temp. Raising at 0.2° C./sec | No |
| 2-6 | Resistance Furnace Heating | In $N_2$ Atmosphere | Maintained For 1 Hour | No |
| 2-6' | Resistance Furnace Heating | In $N_2$ Atmosphere | Maintained For 1 Hour | Yes |
| 2-7 | Resistance Furnace Heating | In The Air | Maintained For 1 Hour | No |
| 2-7' | Resistance Furnace Heating | In The Air | Maintained For 1 Hour | Yes |

| Sample No. | Properties of Forged Body: Amount of Oxygen (%) | Amount of Hydrogen (ppm) | Tensile Strength (kg/mm$^2$) | Elongation (%) | Hardness $H_RB$ |
|---|---|---|---|---|---|
| Example | | | | | |
| 2-1 | 0.23 | 3 | 48 | 1.2 | 89 |
| 2-2 | 0.30 | 4 | 50 | 2.0 | 85 |

TABLE 5-continued

| | | | | | |
|---|---|---|---|---|---|
| 2-3 | 0.29 | 3 | 52 | 3.0 | 86 |
| 2-3' | 0.76 | 4 | 51 | 1.8 | 88 |
| 2-4 | 0.32 | 5 | 50 | 1.8 | 85 |
| Comparative Example | | | | | |
| 2-5 | 0.38 | 8 | 45 | 1.0 | 83 |
| 2-6 | 0.28 | 9 | 49 | 1.8 | 87 |
| 2-6' | 0.38 | 11 | 32 | 0.2 | 82 |
| 2-7 | 0.42 | 17 | 30 | 0.0 | 75 |
| 2-7' | 0.93 | 23 | 23 | 0.0 | 65 |

From the results of Table 5, it is apparent that according to the present invention, degassing is well carried out and forged bodies having well balanced properties such as hardness, tensile strength, elongation, etc. are obtained without deteriorating the quenching effect of the raw material powder because of the small thermal history.

In comparison of the results of 2–3') and 2–6'), it is apparent that in the effective degassing method of the present invention, degassing (removal of adsorbed water) can sufficently be carried out even if there is a large amount of adsorbed water (becoming crystalline water of alumina during heating), while in the degassing method 2–6') of the prior art, it is difficult to remove such a large amount of the adsorbed water and the resulting forged body has inferior properties.

Figure 2:
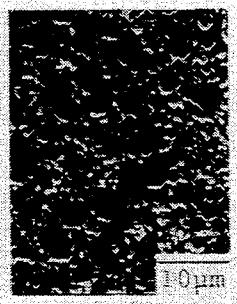
FIG. 2 is an SEM photograph instead of a drawing of a texture of a forged body obtained in Example 2-3) of the present invention.
Figure 3:
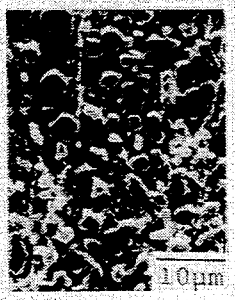
FIG. 3 is an SEM photograph instead of a drawing of a texture of a forged body obtained in Comparative Example 2-6) of the present invention.

The forged bodies obtained in Examples 2-1) and 2-3) according to the present invention and Comparative Example 2-6) according to the prior art, as dsecribed above, were cut and polished, and then after etching strongly, subjected to observing of the structure thereof by SEM (scanning electron microscope), thus obtaining SEM photographs as shown in FIG. 1 to FIG. 3. It is apparent from these photographs that the structures of the forged bodies according to the present invention are clearly finer than that of the prior art.

EXAMPLE 3

The procedures under the conditions of Examples 2-1) and 2-4) and Comparative Examples 2-6) and 2-7) were repeated except using a mixed powder of air-atomized, Al-20Si-5Fe-2Ni alloy powder (mean grain diameter: 50 μm) and alumina powder with a mean grain diameter of 0.5 μm, as a raw material powder, thus obtaining forged bodies 3-1) and 3-2) of the present invention and comparative articles 3-3) and 3-4). The properties measured in the similar manner to Example 2 are shown in Table 6. The quantity of oxygen is a quantity from which the quantity of oxygen contained in the alumina grains has been removed by calculation.

TABLE 6

| | Heating Condition | Amount of Oxygen (%) | Amount of Hydrogen (ppm) | Tensile Strength (kg/mm$^2$) | Elongation (%) | Hardness $H_RB$ |
|---|---|---|---|---|---|---|
| Example | | | | | | |
| 3-1 | 2-1 | 0.26 | 4 | 62 | 0.8 | 108 |
| 3-2 | 2-4 | 0.35 | 3 | 59 | 0.6 | 110 |
| Comparative Example | | | | | | |
| 3-3 | 2-6 | 0.25 | 10 | 48 | 0.4 | 89 |
| 3-4 | 2-7 | 0.53 | 19 | 28 | 0.0 | 68 |

It is apparent from the results of Table 6 that the forged bodies of the present invention have good properties.

EXAMPLE 4

The procedures under the conditions of Examples 2-1) and 2-4) and Comparative Examples 2-6) and 2-7) were repeated except using an air-atomized, Al-12Si- 5 vol % (mean grain diameter: 2 μm) SiC aluminum composite alloy powder (mean grain diameter: 50 μm) as a raw material powder, thus obtaining forged bodies 4-1) and 4-2) of the present invention and comparative articles 4-3) and 4-4). The properties measured in the similar manner to Example 2 are shown in Table 7.

TABLE 7

| | Heating Condition | Amount of Oxygen (%) | Amount of Hydrogen (ppm) | Tensile Strength (kg/mm$^2$) | Elongation (%) | Hardness $H_RB$ |
|---|---|---|---|---|---|---|
| Example | | | | | | |
| 4-1 | 2-1 | 0.26 | 4 | 62 | 0.8 | 108 |
| 4-2 | 2-4 | 0.35 | 3 | 59 | 0.6 | 110 |
| Comparativ Example | | | | | | |
| 4-3 | 2-6 | 0.25 | 10 | 48 | 0.4 | 89 |
| 4-4 | 2-7 | 0.53 | 19 | 28 | 0.0 | 68 |

It is apparent from the results of Table 7 that the forged bodies of the present invention have good properties.

EXAMPLE 5

About 250 g of an air-atomized powder (mean grain diameter: about 50 μm) with a composition of Al-25Si-2.5Cu-1Mg was compacted at a compacting pressure of 4 tons/cm$^2$ in a diameter 100 mm×height 20 mm to give a specific electric resistance of 0.02 Ωcm, heated to 500° C. under the following conditions 5-1) to 5—5), charged into a mold heated at 200° C. when the heating was finished, subjected to powder forging at a compacting pressure of 8 tons/cm$^2$, immediately cooled by immersing in water. Therefore, the product was subjected to natural ageing for 4 days.

5-1) Induction heating in the air (32° C./sec) . . . Present Invention
5-2) Induction heating in the air (8.0° C./sec) . . . Present Invention -continued 5-3) Induction heating in the air (4.0° C./sec) . . . Present Invention
5-4) Induction heating in the air (0.8° C./sec) . . . Present Invention
5-5) Induction heating in the air (0.2° C./sec) . . . Outside Present Invention For comparison, the same compact was heated to 500° C. under the following conditions 5-6) using a resistance heating furnace, forged, then heated at 485° C. for 2 hours and immersed in water to effect a solution treatment and thereafter, subjected to natural ageing for 4 days.

5-6) Resistance furnace heating in $N_2$ atmosphere (maintained for 1 hour) . . . Outside Present Invention
5-7) Resistance furnace heating in the air (maintained for 1 hour) . . . Outside Present Invention
5-8) Resistance furnace heating in vacuum (maintained for 1 hour) moistened . . . Outside Present Invention The properties of the alloy powders thus obtained are shown in Table 8. From the results of Table 8, it is apparent that according to the present invention, forged bodies having well balanced properties such as hardness, tensile strength, elongation, etc. are obtained without deteriorating the quenching effect of the raw material powder because of the good degassing and small thermal history of the aluminum alloy powder forged body according to the present invention.

TABLE 8

| Sample No. | Heating Means | Degassing Conditions: Atmosphere | Temperature Conditions | Moistened |
|---|---|---|---|---|
| Example | | | | |
| 5-1 | Induction Heating | In The Air | Temp. Raising at 32° C./sec | No |
| 5-2 | Induction Heating | In The Air | Temp. Raising at 8.0° C./sec | No |
| 5-3 | Induction Heating | In The Air | Temp. Raising at 4.0° C./sec | No |
| 5-4 | Induction Heating | In The Air | Temp. Raising at 0.8° C./sec | No |
| Comparative Example | | | | |
| 5-5 | Induction Heating | In The Air | Temp. Raising at 0.2° C./sec | No |
| 5-6 | Resistance Furnace Heating | In $N_2$ Atmosphere | Maintained For 1 Hour | No |
| 5-7 | Resistance Furnace Heating | In The Air | Maintained For 1 Hour | No |
| 5-8 | Resistance Furnace Heating | In Vacuum | Maintained For 1 Hour | No |

| Sample No. | Properties of Forged Body: Amount of Oxygen (%) | Amount of Hydrogen (ppm) | Tensile Strength ($kg/mm^2$) | Elongation (%) | Hardness $H_RB$ |
|---|---|---|---|---|---|
| Example | | | | | |
| 5-1 | 0.26 | 4 | 52 | 1.0 | 99 |
| 5-2 | 0.29 | 4 | 55 | 1.2 | 98 |
| 5-3 | 0.30 | 3 | 58 | 1.8 | 98 |
| 5-4 | 0.35 | 5 | 57 | 2.0 | 83 |
| Comparative Example | | | | | |
| 5-5 | 0.40 | 8 | 51 | 1.5 | 80 |
| 5-6 | 0.27 | 8 | 19 | 0.0 | 73 |
| 5-7 | 0.45 | 20 | * | * | 65 |
| 5-8 | 0.38 | 3 | 42 | 0.0 | 83 |

EXAMPLE 6

An atomized powder with a composition of Al-25Si-2.5Cu-1Mg (by weight %) was formed in a shape of $\phi$ 50 mm×50 mm t under a pressure of 4 tons/$cm^2$ by a die wall lubricating mold, heated to a forging temperature for 4 minutes by induction heating and forged in a shape of $\phi$ 53 mm. The forging conditions were a heating temperature of 500° C. and a forging pressure of 5 tons/$cm^2$.

After the forging, the product was subjected to a T6 heat treatment (comprising holding at 490° C. for 1.5 hours, immersing in water and subjecting to an ageing treatment at 180° C. for 6 hours) and subjected to estimation of the strength. The tensile strength was estimated in n=2 to obtain 53 $kg/mm^2$ and 51 $kg/mm^2$.

For comparison, the same powder was subjected to powder forging by mixing with a lubricant and heating in an electric furnace, thus obtaining a tensile strength of 48 $kg/mm^2$ in n=2.

It will be understood from these results that better results are obtained when a raw material powder is previously formed without adding a lubricant thereto and coating an inner wall of a mold.

The foregoing Examples have been given exemplifying the rapidly solidified powder, but the method of the present invention can also be applied to degassing of other powders than the rapidly solidified powder with a merit of lowering of the production cost.

EXAMPLE 7

A gas atomized powder (Al-7.3Ni-2.9Fe) was pressed at a compacting pressure of 4 tons/$cm^2$ to prepare three samples each having a shape of $\phi$ 70 mm×25 mmt, heated to 550° C. for 2 minutes by induction heating for one sample, by radiation heating for another sample and by direct electric heating for a further sample, and then forged in $\phi$ 72 mm at a forging pressure of 8 tons/$cm^2$ and after the forging, water-cooled. The properties of the products at room temperature were as follows:

Induction-heated product: tensile strength 62.3 $kg/mm^2$, elongation 13.5%, $K_{Ic}$28.0 $kg/mm^2\sqrt{m}$ Radiation-heated product: tensile strength 60.1 kg/mm$^2$, elongation 13.0%, Direct electrically-heated product: tensile strength 63.4 kg/mm$^2$, elongation 13.6%

EXAMPLE 8

A gas atomized powder (Al-8.8Fe-3.7Ce) was pressed at a compacting pressure of 4 tons/cm$^2$ to prepare a samples having a shape of $\phi$ 70 mm$\times$25 mm t, induction-heated to 550° C. for 1.5 minutes and then forged in $\phi$ 72 mm at a forging compacting pressure of 8 tons/cm$^2$ and after the forging, water-cooled. The properties of the product at room temperature was as follows:

Tensile strength: 65.2 kg/mm$^2$ and elongation: 16.2%

EXAMPLE 9

A gas atomized powder (Al-8Zn-2.5Mg-1Cu-1.6Co) was pressed at a compacting pressure of 4 tons/cm$^2$ to prepare a sample having a shape of $\phi$ 70 mm$\times$25 mm t, induction-heated to 530° C. for 1 minute and then forged in $\phi$ 72 mm at a forging pressure of 8 tons/cm$^2$. After the forging, the temperature was lowered to 460° C. and accordingly, the product was reheated to 520° C. in 1 minute by induction heating, water-cooled and subjected to natural ageing for 4 days, followed by examining the properties at room temperature.

Tensile strength: 70.2 kg/mm$^2$ and elongation: 12.5%

EXAMPLE 10

10 g of an air-atomized powder with a composition of Al-25Si-3Cu-1Mg was compacted at a compacting pressure of 4 tons/cm$^2$ in a shape of 10$\times$18$\times$30 mm and heated to 510° C. for 4 minutes by an infrared radiation heating in the stagnant atmosphere, followed by forging. A metallic mold of 10.5$\times$10.5 mm was used at a mold temperature of 400° C.. The forging pressure was 8 tons/cm$^2$. After the forging, the product was water-cooled and then subjected to examination of the properties without heat treatment.

Tensile strength: 58 kg/cm$^2$, fracture elongation: 3.0% (at room temperature)

The same green compact was heated to 510° C. for 4 minutes in a nitrogen stream (7 liters/min) and then forged under the same conditions as described above.

Tensile strength: 51 kg/cm$^2$, fracture elongation: 2.1% (at room temperature)

EXAMPLE 11

20 kg of an air-atomized powder with a composition of Al-17Si-5Fe-3Cu-1Mg was subjected to CIP (compacting pressure: 2 tons/cm$^2$) to prepare a green compact with a dimension of $\phi$ 180$\times$300 mm.

The resulting compact was subjected to:

| | |
|---|---|
| ① ambient heating in $N_2$ atmosphere | (450° C. $\times$ 4 hours)<br>(490° C. $\times$ 4 hours) |
| ② induction heating in the air | (temperature raising to 460° C. in 16 minutes)<br>(temperature raising to 500° C. in 16 minutes) |

These samples were extruded in $\phi$ 44 (extrusion ratio: 21) by a container with a diameter of $\phi$ 200, cooled after the extrusion and subjected to examination of the properties of a F material and then to a T6 treatment (470° C. $\times$2 hours→water-cooled 175° C.$\times$6 hours) to examine the properties thereof.

Furthermore, after the extrusion, the sample was charged in a furnace at 485° C. for 10 minutes, water-cooled, subjected to an ageing treatment of 175° C.$\times$6 hours and reheated to obtain a T6 material.

3. Similarly, 250 g of the powder was compacted in $\phi$ 80 mm (metallic mold with lubricating wall: pressure 4 tons/cm$^2$), induction-heated in the air(temperature raising of to 520° C. in 2.5 minutes), charged in a metallic mold with $\phi$ 82 and subjected to powder forging at a pressure of 8 tons/cm$^2$. After the forging, the product was immediately water-cooled to obtain a F material.

After the forging, the product was induction-heated to 485° C. for 1 minute, water-cooled and subjected to an ageing treatment of 175° C.$\times$6 hours to obtain a rapidly reheated T6 material.

After the forging, the product was charged in a furnace at 485° C. for 10 minutes, water-cooled and subjected to an ageing treatment of 175° C.$\times$6 hours to obtain a reheated T6 material.

After the forging, the product was directly water-cooled and then subjected to a T6 treatment (i.e. subjected to 485° C.$\times$2 hours, water-cooling and a treatment of 175° C.$\times$6 hours) to obtain a T6 material.

The above described samples were subjected to examination of the properties, thus obtaining results shown in Table 9.

TABLE 9

| Sample No. | Solidified Material | Heating Temp. (°C.) | $H_RB$ | Tensile Strength (kg/cm$^2$) | Elongation (%) | Amount of Hydrogen (ppm) | Remarks |
|---|---|---|---|---|---|---|---|
| 1 | ①-F material | 450 | 78 | 45 | 0.4 | 18 | A |
| 2 | ①-T6 material | | 88 | 49 | 1.0 | — | A |
| 3 | ①-F material | 490 | 75 | 41 | 1.4 | 15 | A |
| 4 | ①-T6 material | | 85 | 43 | 1.2 | — | A |
| 5 | ②-F material | 460 | 89 | 53 | 1.3 | 14 | A |
| 6 | ②-Reheated T6 | | 93 | 55 | 0.9 | — | A |
| 7 | ②-T6 material | | 92 | 50 | 1.1 | — | A |
| 8 | ②-F material | 500 | 88 | 57 | 2.6 | 9 | B |
| 9 | ②-Reheated T6 | | 91 | 59 | 2.1 | — | B |
| 10 | ②-T6 material | | 89 | 54 | 1.8 | — | B |
| 11 | ③-F material | 520 | 92 | 61 | 2.8 | 7 | B |
| 12 | ③-Rapidly Reheated T6 | | 96 | 62 | 2.2 | — | B |
| 13 | ③-Reheated T6 | | 93 | 60 | 2.0 | — | B |

TABLE 9-continued

| Sample No. | Solidified Material | Heating Temp. (°C.) | $H_RB$ | Tensile Strength (kg/cm²) | Elongation (%) | Amount of Hydrogen (ppm) | Remarks |
|---|---|---|---|---|---|---|---|
| 14 | ③-T6 material | | 88 | 57 | 1.9 | — | B |

Note)
①~③ of Solidified Material correspond to the treatments ①~③ in Example 11.
A: Comparative Example
B: Example The following matters are apparent from the foregoing results.

(1) In extrusions, the rapidly heating method according to the present invention is also useful.

(2) The product obtained by rapidly heated to a lower temperature in the extrusion exhibits a smaller elongation.

(3) The product obtained by rapidly heated to a lower temperature in the extrusion exhibits a larger amount of hydrogen.

(4) When rapidly heating and extruding according to the present invention, the reheated T6 gives better properties than the ordinary T6.

(5) Even the F material gives sufficient properties when rapidly heating and powder forging according to the present invention.

(6) When rapidly heating and powder forging according to the present invention, the reheated T6 material gives better properties than the T6 material and the rapidly reheated T6 material gives better properties than the reheated T6 material.

(7) In the articles of the present invention, both the tensile strength and fracture elongation can simultaneously be improved more than the prior art materials.

EXAMPLE 12

The above described Sample Nos. 2 and 11 were subjected to examination of the tensile strength and elongation at 300° C.:

| | | |
|---|---|---|
| Sample No. 2 | Material . . . 22 kg/mm², 3.5% elongation | Comparison |
| Sample No. 11 | Material . . . 28 kg/mm², 5.6% elongation | Present Invention |

Accordingly, it is apparent that the article of the present invention is also excellent in heat resistance.

EXAMPLE 13

250 g of a rotary disk atomized powder with a composition of Al-8Fe-4Mo was compacted in $\phi$ 80 mm (metallic mold with lubricating wall surface) and heated under following conditions:

| | |
|---|---|
| induction heating in the air | (temperature raising to 510° C. in 1.0 minute)<br>(temperature raising to 650° C. in 1.0 minute) |

The product was charged in a metallic mold of $\phi$ 82 mm and subjected to powder-forging at a pressure of 8 tons/cm². After the forging, the product was cooled to examine the properties. The results are shown in Table 10.

TABLE 10

| Heating Temperature (°C.) | Tensile Strength (kg/mm²) | Fracture Elongation (%) |
|---|---|---|
| 510 | 67 | 4.5 |
| 650 | 66 | 12.3 |

As described above, in an aluminum alloy with a high melting point, heating at a temperature exceeding 600° C. gives sometimes good results.

Utility and Possibility on Commercial Scale

Since according to the present invention, a sufficient degassing can be carried out in simpler steps and more economical manner and with a lower thermal history than in the prior art, all the tensile strength, elongation and fracture toughness value can be improved without carrying out heating in an inert atmosphere, degassing in vacuum and plastic deformation after solidifying. Thus, the method of the present invention is useful for the industry.

We claim:

1. A method of degassing an aluminum alloy powder, characterized by preforming an aluminum powder, aluminum alloy powder or aluminum composite alloy powder or mixed powders thereof with non-metallic grains to give a specific electric resistance of at most 0.2Ωcm, subjecting the preform directly to induction heating in an atmosphere at normal pressure, temperature-raising to 400° to 600° C. at a temperature gradient of at least 0.4° C./sec in a temperature range of at least 300° C., and removing heat-decomposable volatile components to obtain a hydrogen content of at most 10 ppm.

2. The method of degassing an aluminum alloy powder, as claimed in claim 1, wherein the induction heating is carried out in the air.

3. The method of degassing an aluminum alloy powder, as claimed in claim 1 or claim 2, wherein after degassing by the induction heating, the preform is cooled in an inert gas atmosphere.

4. A method of solidifying a rapidly solidified aluminum alloy powder, characterized by preforming an aluminum powder, aluminum alloy powder or aluminum composite alloy powder or mixed powders thereof with non-metallic grains to give a specific electric resistance of at most 0.2 Ωcm, subjecting the preform directly to induction heating in a stagnant atmosphere at normal pressure, maintaining a temperature-raising gradient of at least 0.4° C./sec at a temperature range of at least 300° C., temperature-raising to 400° to 600° C. corresponding to a temperature of at least 30° C. higher than the vacuum degassing temperature applied to a case of extruding the above described powder, removing heat-decomposable volatile components to obtain a hydrogen content of at most 10 ppm, then directly subjecting a product to hot working and solidifying the product.

5. The method of solidifying a rapidly solidified aluminum alloy powder, as claimed in claim 4, wherein the temperature raised by the induction heating is in the range of 400° C. to the melting point.

6. The method of solidifying a rapidly solidified aluminum alloy powder, as claimed in claim 4 or claim 5, wherein the hot working is a powder forging.

7. The method of solidifying a quenched aluminum alloy powder, as claimed in claim 4, wherein the induction heating is carried out in the stagnant atmosphere.

8. The method of solidifying a rapidly solidified aluminum alloy powder, as claimed in claim 4 or claim 5, wherein immediately after forging, the product is quenched at a rate of at least 10° C./sec or reheated at a temperature of at most the forging temperature to at least (the forging temperature −50° C.) without cooling to room temperature, thus effecting quenching and solution treatment.

9. The method of solidifying a rapidly solidified aluminum alloy powder, as claimed in any one of claims 4 to 6, wherein the preforming of the powder is carried out by coating an inner wall of a forming metallic mold with a wetting agent without adding an organic wetting agent to the powder.

10. The method of solidifying a rapidly solidified aluminum alloy powder, as claimed in any one of claims 4 to 7, wherein a radiation heating or direct electric heating is used instead of the induction heating.

* * * * *